United States Patent [19]

Alpert

[11] Patent Number: 4,541,013

[45] Date of Patent: Sep. 10, 1985

[54] FOOTBALL SIGNALING SYSTEM

[76] Inventor: Sidney A. Alpert, 12514 Davan Dr., Silver Spring, Md. 20904

[21] Appl. No.: 399,338

[22] Filed: Jul. 19, 1982

[51] Int. Cl.[3] ..... H04N 5/24; H04N 7/08

[52] U.S. Cl. ..... 358/142; 358/183; 340/323 R; 273/55 R

[58] Field of Search ..... 358/142, 183, 22; 340/323 R, 323 B; 272/3; 273/55 R, 55 A, 55 C

[56] References Cited

U.S. PATENT DOCUMENTS

| | | | |
|---|---|---|---|
| 2,164,297 | 6/1939 | Bedford . | |
| 2,275,026 | 3/1942 | Bedford . | |
| 2,487,641 | 11/1949 | Denk . | |
| 2,568,166 | 9/1951 | Perry | 358/183 |
| 2,621,246 | 12/1952 | Clayden . | |
| 2,784,247 | 3/1957 | Hurford . | |
| 2,851,519 | 9/1958 | Schira . | |
| 3,611,333 | 10/1971 | Conigliaro | 340/224 |
| 3,651,507 | 3/1972 | Abbott | 340/323 |
| 3,825,261 | 7/1974 | Zapos | 273/55 R |
| 4,055,839 | 10/1977 | Skeggs | 340/279 |
| 4,139,860 | 2/1979 | Micic | 358/183 |
| 4,162,449 | 7/1979 | Bouyssounouse | 340/312 |
| 4,163,992 | 8/1979 | Inaba | 358/183 |
| 4,196,449 | 4/1980 | Tama | 358/183 |
| 4,215,856 | 8/1980 | Schmall | 272/3 |
| 4,238,773 | 12/1980 | Tsuboka | 358/183 |
| 4,437,115 | 3/1984 | Yoshida | 358/183 |

FOREIGN PATENT DOCUMENTS

| | | | |
|---|---|---|---|
| 1541166 | 2/1979 | United Kingdom | 358/183 |

*Primary Examiner*—Tommy P. Chin

*Attorney, Agent, or Firm*—Thomas J. Greer, Jr.

[57] ABSTRACT

A way of enhancing spectator enjoyment of football. Each referee has a holder for the flag. When an off-side, clipping, backfield in motion, etc., is observed, the referee drops the flag to signal a rules infraction. The holder senses the removal of the flag. By virtue of a radio link, the sensing of the flag removal is relayed as to a receiving station. In turn, a signal flashes on the stadium scoreboard and on the televised transmission as viewed on a television receiver screen. By virtue of this arrangement, the spectators know that the play may be called back, even though the players themselves may not be aware that a flag has been dropped to signal a rules infraction and will continue to play.

12 Claims, 3 Drawing Figures

FOOTBALL SIGNALING SYSTEM

This invention relates to a device for enhancing the viewing enjoyment of sports audiences, particularly those viewing the game of football. The invention also exhibits utility in any sport wherein one or more referees signal the occurrence of an infraction of the rules of the game by the dropping of a flag or other object onto the ground.

In the game of football, after a play has commenced, there often occur rule infractions by one or more players of either of the two competing teams. It is customary for one or more referees to drop a handkerchief, termed a flag, on the ground upon the referee's observation of a rules infraction. However, such dropping is not always immediately observed, either by the opposing players or by the viewing audience. The latter is usually composed of two groups. The first group is the spectators at the playing field, usually seated in a stadium, with the stadium having the usual scoreboard. The second group of spectators is defined by the television audience.

It sometimes occurs that a play will continue for an appreciable length of time after the flag has been dropped, the players being unaware of such notice of rules infraction and therefore continuing the play until a tackle is made, a goal is scored, or other action completing the play that is visible to all.

According to the practice of this invention, a method and apparatus is set forth whereby the spectators are apprised of the action of one or more referees in throwing the flag on the playing field. Thus, the spectators immediately know of such a rules infraction even though some or perhaps all of the players on the two teams may not be aware of it. The invention is carried out by means of a switch and radio transmitter, carried by each of the referees. The throwing down of the flag or other marker onto the field actuates the transmitter, and, by virtue of a radio link, this activation is sensed by a nearby receiver. The receiver is in turn coupled to the stadium scoreboard and/or to television transmitting apparatus where an appropriate indication, such as F or a waving flag simulation is flashed onto either the scoreboard or to the television viewing screen or to both. In those cases where recordation of the sports contest is made, as by photographic film or magnetic tape or other conventional means, the same or a similar signal is imprinted on the information storage mediun, i.e., the photographic film, magnetic tape, or the like. Thus, viewers at a later time may also enjoy the advantages of this invention.

Figure 1:
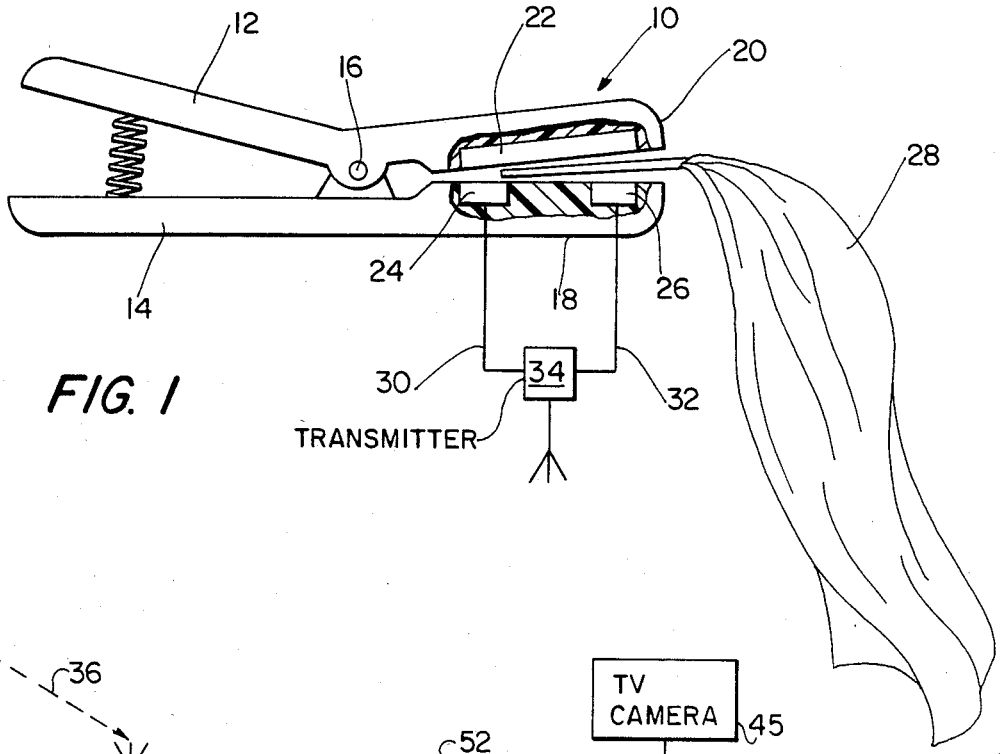
FIG. 1 is a view showing one type of switch which may be employed, the switch being carried on the person of each of the officials or referees at the football game.

Referring now to FIG. 1 of the drawings, the numeral 10 denotes generally a switch which is carried by each of the referees or officials as by on a belt or other convenient manner. The switch includes pivoted arms 12 and 14 formed from an electrically insulating material such as a plastics material, linked by a pivot 16 and including gripping tip portions 18 and 20. Arms 12 and 14 are normally spring urged so as to close together the tips 18 and 20. The numeral 22 denotes a conductive material such as metal carried by arm 12, while the numerals 24 and 26 denote spaced metal contacts carried by other arm 14. The numeral 28 denotes the flag carried by the referee, the flag normally being pinched and held between tips 18 and 20. The numerals 30 and 32 denote, respectively, conductors leading from contacts 24 and 26 which lead to a radio transmitter 34, also carried by the referee. In the position shown at FIG. 1, flag 28, formed of cloth or the like, prevents electrical contact of conductor 22 with terminals 24 and 26. When however the flag is removed by the referee from the swith 10, in the position shown at FIG. 1, and thrown onto the playing field, the normal spring bias of arm 12 causes conductor 22 to establish an electrical circuit between contacts 24 and 26, to thereby activate referee carried transmitter 34.

Figure 2:
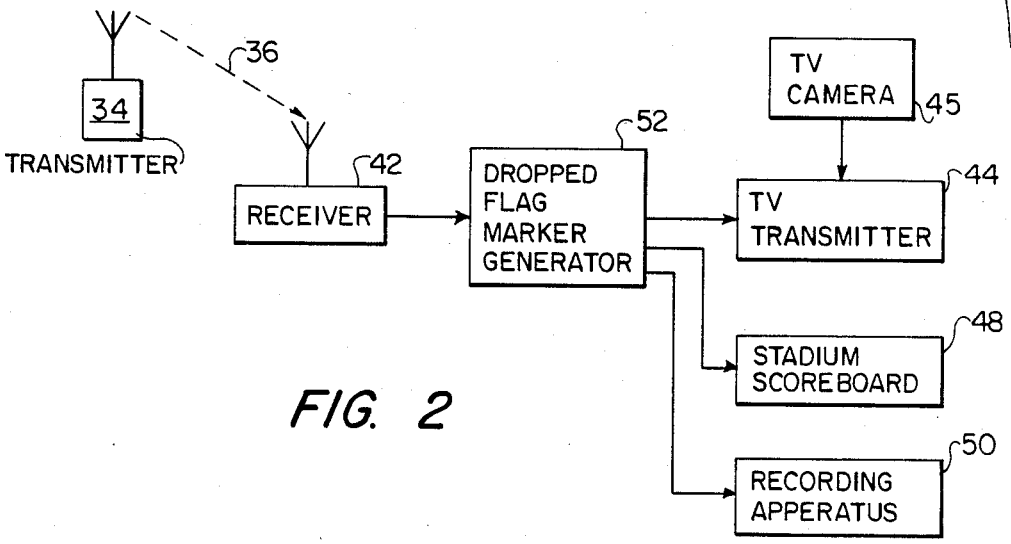
FIG. 2 is a schematic view indicating the entire system of this invention.

Referring now to FIG. 2 of the drawings, transmitter 34 is coupled to radio receiver 42 by means of a radio link, schematically designated by the dashed line 36. The receiver 42 may be located adjacent the football field, as on the sidelines. Receiver 42 is connected or linked through flag marker generator 52 to television transmitter 44 and may also be connected to stadium scoreboard 48 and photographic film recording apparatus 50. Marker generator 52 superimposes the image of F, or a waving flag simulation, or other flag dropping notification, on the television viewers' screen as well as on the stadium scoreboard, as well as the photographic film as recorded by apparatus 50. The construction of devices for such superimposition on television viewing screens is known, as shown for example by the following U.S. Pat. Nos.:

2,164,297: Bedford;
2,275,026: Bedford;
2,487,641: Denk;
2,568,166: Perry;
2,621,246: Clayden;
2,784,247: Hurford;
2,851,519: Schira;
4,139,860: Micic;
4,163,992: Inaba;
4,196,449: Tama;
4,238,773: Tsuboka.

Figure 3:
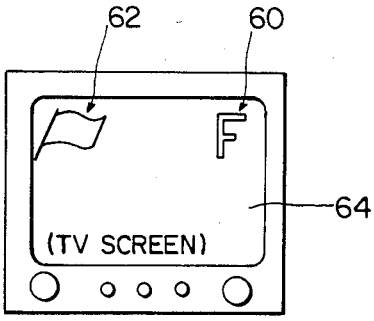
FIG. 3 is a partially schematic view of a television screen showing a typical notification of a rules infraction according to this invention.

In operation, when the flag is thrown on the playing field, transmitter 34 is activated thus sending a signal to receiver 42. Upon receipt of this signal, receiver 42 causes television transmitter 44 and stadium scoreboard 48 to display by means of generator 52 an indication of a flag being thrown on the field. FIG. 3 indicates a typical form of such indication, being, by way of example, the capital letter F denoted by the numeral 60 or a waving flag simulation 62 being displayed on television screen 64. The reader can easily visualize that screen 64 could be the stadium scoreboard as well as a television screen, to thereby immediately inform stadium spectators of the dropping of the flag.

While each referee-carried transmitter has been shown in FIG. 1 to be actuated by a pivoted clamp switch 10 and associated electrical contacts 24 and 26, the reader will understand that many other forms of switches may be employed for activating transmitter 34. For example, the flag 28 may carry a conductive material, and function as one plate of a capacitive switch.

The exact form of the switch 10 does not limit or define the practice of the invention.

Recording apparatus 50 may also be coupled to receiver 42 through marker generator 52, so that later viewing audiences may also be apprised in the same manner as those viewing in real time.

The prior art is aware of somewhat similar systems. For example, U.S. Pat. No. 4,215,856 issued to Schmall et al (Class 272, Subclass 3) denotes a system wherein the actuation of a whistle by the referee actuates a transmitter carried by the referee to signal such whistle blowing to a time apparatus. The time apparatus whistle is located on the sidelines of the playing area. Further, U.S. Pat. No. 3,825,261 issued to Zapos (Class 273, Subclass 55R) discloses a system for use in a football game wherein the scoring of a goal is indicated to the spectators at a playing field, particularly useful when a game is played at night. There, the referee points a source of illumination carried by him/her to a receiver mounted on the goal posts, the ends of the uprights of the goal posts being consequently illuminated. U.S. Pat. No. 3,651,507 issued to Abbott (Class 340, Subclass 323) discloses a system somewhat similar to that of the noted Schmall system in that the blowing of a whistle at a sports even initiates the operation of a timing mechanism. Still further, U.S. Pat. No. 4,162,449 issued to Bouyssounouse (Class 325, Subclass 55) discloses a system wherein an individual carries a portable radio transmitter, the activation of which is sensed by a receiving station for the purpose of noting a signal. U.S. Pat. No. 3,611,333 issued to Conigliaro (Class 340, Subclass 224) discloses a system for the remote sensing of a condition. In this patent, the sensed condition is the opening of a mail box adjacent a dwelling, such opening causing the actuation of a radio transmitter, with the transmission being sensed inside the dwelling by a suitable display device. U.S. Pat. No. 4,055,829 issued to Skeggs (Class 340, Subclass 279) discloses a switch device coupled to a transmitter, both being fastened to the body of a horse, to remotely indicate a position of the horse.

While the above patents disclose the broad concept of the remote sensing of a condition, by means of a radio link, no one of them is addressed to enhancing viewer enjoyment of a sport such as football by providing an immediate apprisement to the viewers of a possible rules infraction. Although useful for viewers at a football stadium, the rules infraction being displayed on the stadium scoreboard, even greater enjoyment is offered to television viewers by the practice of this invention. At the stadium the viewers see the entire playing field and accordingly can observe all of the referees and their actions. Television viewers, however, are limited to the part of the field selected by the television camera operators on any given play and hence cannot simultaneously view the action of a play or down with the actions of the referees.

In the practice of this invention either wireless or cable transmitted television may be employed.

It is claimed:

1. An arrangement for enhancing the viewing enjoyment by spectators of a sports game or contest of the type involving a playing field and two teams of opposing players thereon which engage in the play of a game or contest, the game or contest being one in which at least one referee is present for the purpose of observing any infractions of rules of the game or contest, the referee signifying an infraction of the rules by dropping a flag carried by him, comprising, means carried by the referee for sensing the removal of the flag from its normal location on or about the body of the referee, a spectator viewed video display, means for transmitting said sensing of the flag removal to a receiver coupled to the spectator viewed video display, a marker generator superimposing a rules infraction notification on the spectator viewed display upon receiving said sensing of the flag removal from its said normal position, whereby the viewers of the display are made immediately aware of a rule infraction, even though some or all of the players of the two teams may not be so immediately aware of said rule infraction and thereby might and sometimes do continue to play the game or contest in ignorance of the noting of said rule infraction.

2. The arrangement of claim 1 wherein the means carried by the referee for sensing the removal of the flag is an electrical switch which is actuated by said removal of the flag.

3. The arrangement of claim 2 wherein the means for transmitting the sensing of the flag removal to the marker generator is a radio transmitter carried by the referee, the radio transmitter being actuated by the switch.

4. The arrangement of claim 3 wherein the spectator viewed display is a television receiver screen.

5. The arrangement of claim 2 wherein the switch normally clamps the flag and is electrically open in that normal condition and wherein removal of the flag from the switch causes the switch to electrically close.

6. The arrangement of claim 5 wherein the spectator viewed display is a television receiver screen.

7. The arrangement of claims 1 or 2 including means for recording the play of the two teams for later viewing.

8. The arrangement of claim 7 wherein the spectator viewed display is a television receiver screen.

9. The arrangement of claims 1 or 2 wherein the spectator viewed display is a television receiver screen.

10. A method of enhancing viewing enjoyment by spectators of a sports game or contest, the game or contest being viewed by television transmitted by wireless or by cable, the game or contest being one wherein a referee is on a playing field with opposing players to note any rules infractions of the game or contest, the referee carrying a radio transmitter, the method including the steps of, the referee initiating actuation of the radio transmitter carried by him to transmit a radio signal upon his observation of an infraction of the rules of the game or contest, actuating a marker generator upon receiving said transmitted radio signal, the marker generator causing a display to be superimposed on the screens of television viewers upon actuation of the radio transmitter by the referee, the display denoting a rules infraction, whereby television viewers are informed of the observance of a rules infraction by the referee immediately upon the referee's actuation of the radio transmitter, even though the attention of the television viewers may be, at such times, on a part of the playing field on which the referee is not seen on the television viewing screens.

11. The method of claim 10 including the step of recording the play of the game or contest for later viewing.

12. An apparatus for enhancing the viewing enjoyment by television spectators of a sporting event monitored by a referee who observes any rule infractions of the sporting event and makes known such infractions by dropping a flag carried by him, including, a switch means to sense the removal of a flag carried by the referee, a transmitter to transmit a signal in response to the actuation of said switch, a receiver to receive said transmitted signal, a signal generating means to generate a marker signal in response to said received signal, means to superimpose the marker signal on a television display screen to indicate a rule infraction, whereby the television viewers of the display are made immediately aware of a rule infraction, even though some or all of the players of the two teams may not be so immediately aware of said rule infraction and thereby might and sometimes do continue to play the game or contest in ignorance of the noting of said rule infraction.

* * * * *